United States Patent [19]

Onoe et al.

[11] 4,092,178

[45] May 30, 1978

[54] PROCESS FOR PRODUCING A STEEL HAVING EXCELLENT STRENGTH AND TOUGHNESS

[75] Inventors: Yasumitsu Onoe; Yoshikazu Matsumura; Hiroshi Katoh; Koe Nakajima; Shozo Sekino, all of Kitakyushu, Japan

[73] Assignee: Nippon Steel Corporation, Tokyo, Japan

[21] Appl. No.: 638,095

[22] Filed: Dec. 5, 1975

[30] Foreign Application Priority Data

Dec. 11, 1974 Japan ..... 49-141486

[51] Int. Cl.[2] ..... C21D 9/48

[52] U.S. Cl. ..... 148/2; 148/3; 148/12 F; 75/123 B; 75/124

[58] Field of Search ..... 75/124, 123 B; 148/2, 148/12, 3, 111; 164/76, 82; 29/527.7

[56] References Cited

U.S. PATENT DOCUMENTS

| | | | |
|---|---|---|---|
| 3,876,476 | 4/1975 | Matsuoka et al. | 148/111 |
| 3,948,691 | 4/1976 | Matsushita et al. | 148/111 |
| 3,971,678 | 7/1976 | Vlad | 148/111 |
| 3,990,924 | 11/1976 | Matsumoto et al. | 148/111 |

FOREIGN PATENT DOCUMENTS

| | | | |
|---|---|---|---|
| 845,167 | 8/1960 | United Kingdom | 148/111 |

*Primary Examiner*—Walter R. Satterfield

*Attorney, Agent, or Firm*—Wenderoth, Lind & Ponack

[57] ABSTRACT

A process for producing a steel having excellent strength and toughness, which comprises continuously casting a molten steel containing 0.01 – 0.10% Al and 0.002 – 0.009% N with an average cooling rate of not lower than 3° C/min. down to 500° C to obtain a steel slab heating the steel slab to a temperature ranging from 900° to 1150° C and rolling the steel slab.

2 Claims, 7 Drawing Figures

PROCESS FOR PRODUCING A STEEL HAVING EXCELLENT STRENGTH AND TOUGHNESS

BACKGROUND OF THE INVENTION

Conventionally a method called as "controlled rolling" has been applied for production of a high strength and toughness (tenacity) steel, according to which method the steel slab is heated to about 1250° C and the finishing rolling temperature is restricted.

However, this conventional method is inherently a temperature controlling method so that subsequent working steps can not be performed until the temperature of the steel material lowers to a certain temperature, thus suffering from remarkably low productivity, and the steel products thus obtained have considerable variation in their quality.

The present inventors have conducted various extensive experiments and studies for the purpose of developing a steel having excellent strength and toughness with less variation, and have found that when a steel slab obtained by continuous casting of a molten steel containing Al and N is heated to a temperature not higher than 1150° C and rolled, the nuclearation of AlN takes precedence over the growth of AlN and fine AlN is formed, thus giving a rolled steel material having excellent strength and toughness.

SUMMARY OF THE INVENTION

The present invention relates to a novel process for producing a steel of a fine grain structure having excellent strength and toughness, and the particular process comprises continuously casting a molten steel containing 0.01 - 0.10% Al, 0.002 - 0.009% N with a cooling rate of not lower than 3° C/min. down to 500° C to obtain a steel slab, heating the steel slab to a temperature ranging from 900° to 1150° C and then rolling the steel slab thus heated.

DETAILED DESCRIPTION OF THE INVENTION

The present invention will be described in details referring to the attached drawings.

FIG. 1 shows the austenite grain in case of heating the continuously cast steel slab at 1100° C for 60 minutes.

FIG. 2 shows the austenite grain obtained when the continuously cast steel slab is heated at 1000° C for 60 minutes.

FIG. 3 shows the austenite obtained when the ingot-breaking steel slab is heated at 1100° C for 60 minutes, and FIG. 4 shows the austenite grain obtained when the ingot-breaking steel slab is heated at 1000° C for 60 minutes.

A molten steel containing 0.01 to 0.10% Al and 0.002 to 0.009% N is prepared in an ordinary melting furnace such as a convertor and an electrical furnace. In this case, the Al content and the N content in the molten steel are required for causing dispersion and precipitation of fine AlN nuclei at the rolling temperature as defined hereinafter, and when Al or N is contained below the above range the growth of the austenite grain is not effectively restricted, and on the other hand, when Al or N is contained beyond the above range there is much tendency of embrittlement of the steel.

From the molten steel as mentioned above, steel slabs are continuously cast into slabs with a rapid cooling rate not lower than 3° C/min. down to 500° C so as to prevent the formation and growth of the AlN nuclei. Further according to a preferred embodiment of the present invention, the continuous casting is done with a cooling rate not lower than 6° C/min. down to 500° C so as to obtain steel slabs containing nitrogen which precipitates as AlN in an amount not larger than 40% of the total nitrogen.

Figure 1:
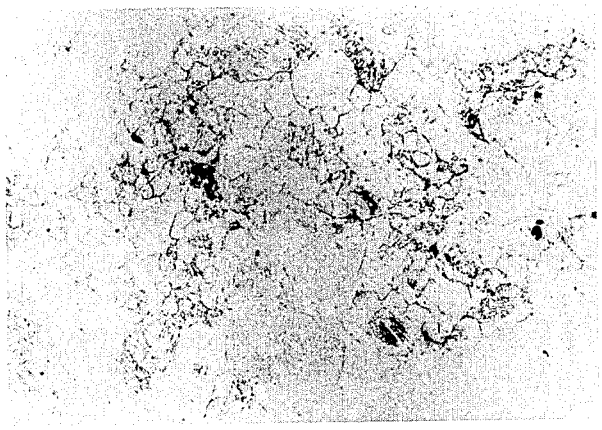
FIGS. 1 - 4 are respectively a photograph showing the austenite grains produced when steel slabs made by a continuous casting method and an ingot-breaking method are heated to temperatures of 1000° and 1100° C.
Figure 2:
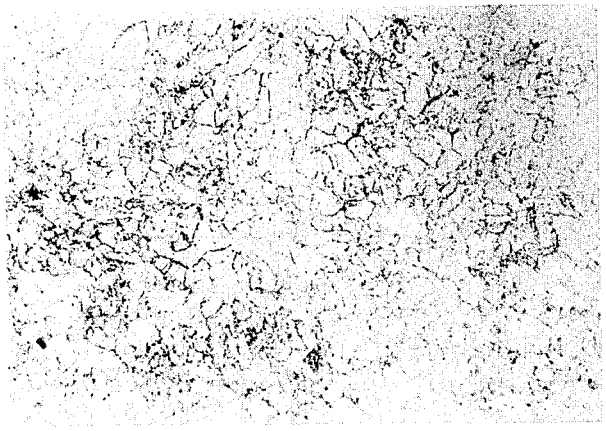
Figure 3:
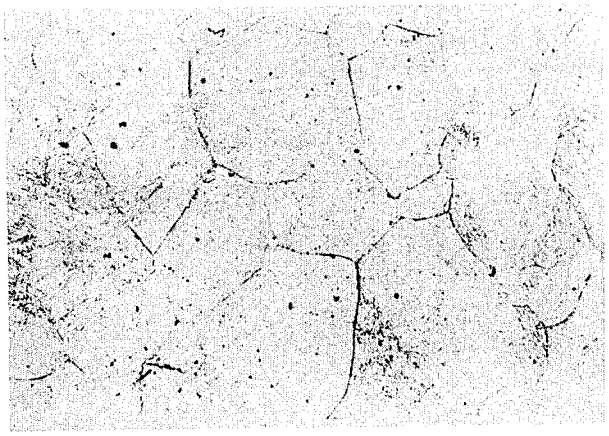
Figure 4:
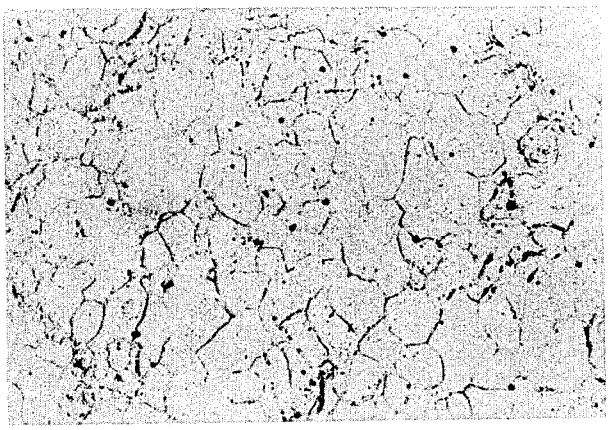

The steel slabs thus produced by continuous casting shows a remarkably fine grain structure after the heating as shown in FIG. 1 and FIG. 2, as compared with that of steel slabs produced by ingot-breaking as shown in FIG. 3 and FIG. 4.

The difference in the grain structure as above derives from the fact that Al and N dissolved in solution in the steel precipitate during the slab production or they do not.

Namely, when the steel slabs are prepared by continuous casting with a cooling rate not lower than 3° C/min. Al and N which have been dissolved in solution in the steel until the completion of the slab production precipitate as fine AlN at the time of heating and thus fine AlN is effective to prevent austenitic grain growth, whereas when the steel slabs are prepared by ingot breaking with a slow cooling rate, about 50% AlN has been already formed during the slab production so that the preventive force against the grain growth is week.

Then the steel slabs produced by continuous casting are heated to a temperature ranging from 900° to 1150° C and hot rolled into steel products such as plates, sheets, and sections. Regarding the heating temperature, a lower temperature is more preferable in the austenite zone but causes difficulties in the rolling. Thus the lower limit is set at 900° C.

Figure 5:
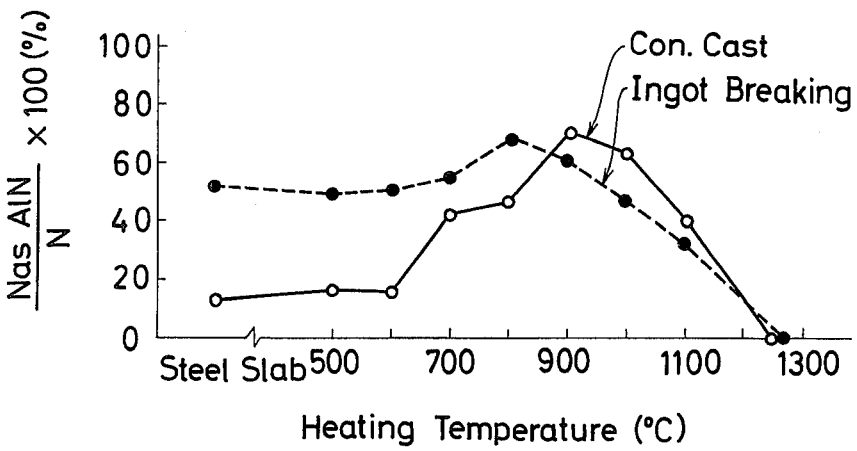
FIG. 5 shows the relation between the heating temperature and AlN precipitation in steel slabs obtained by a continuous casting as well as ingot-breaking.
Figure 6:
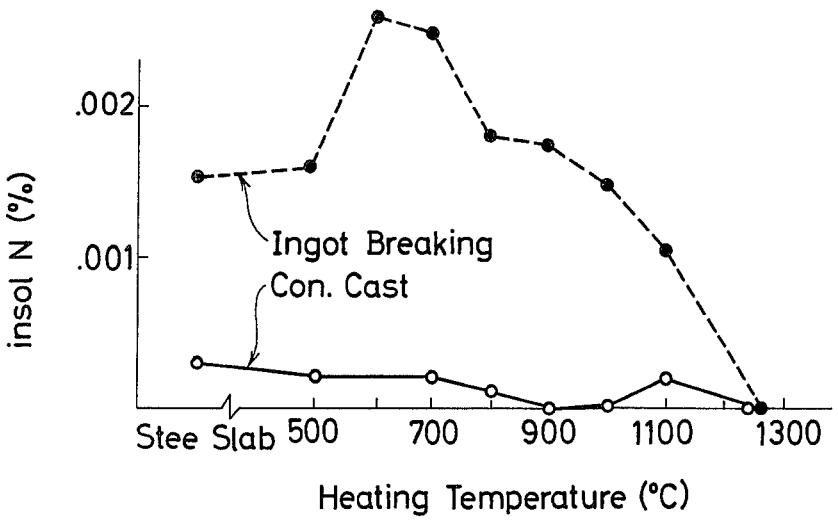
FIG. 6 shows relation between the acid insoluble nitrogen content and the heating temperature.

FIG. 5 shows the AlN precipitation behavior (N as AlN/N × 100) when the steel slabs prepared by continuous casting and ingot-breaking are heated to various temperatures and FIG. 6 shows the analysis of the insoluble N which is considered to be converted into coarse AlN.

Figure 7:
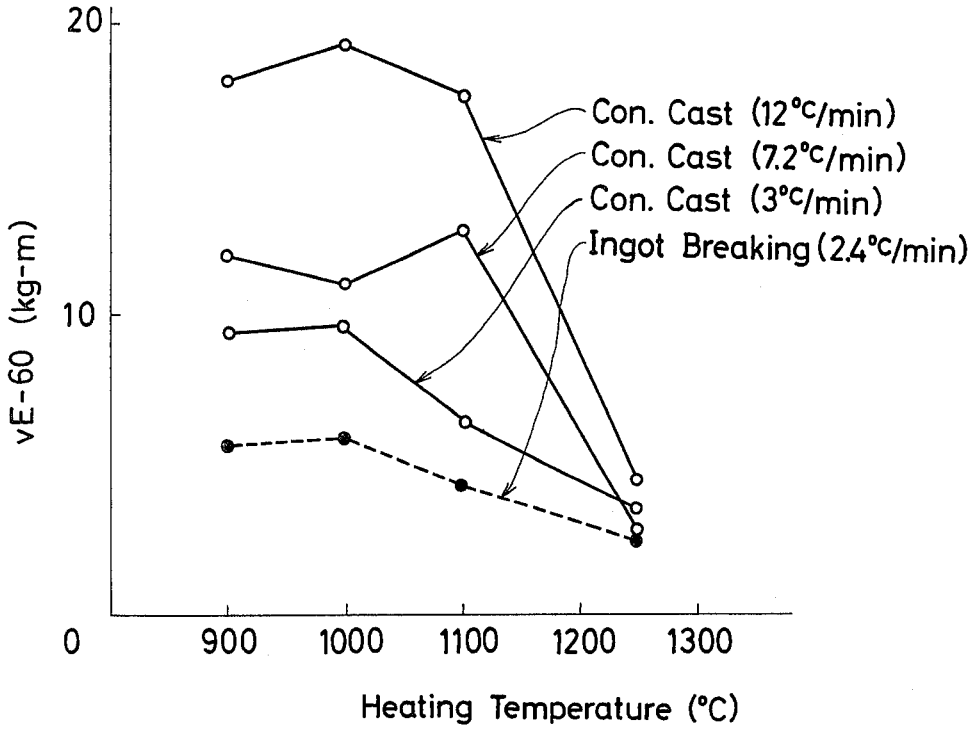
FIG. 7 shows the relation between the toughness of the steel sheets and the heating temperature of the steel slabs.

As clearly understood from FIG. 5 and FIG. 6, even when AlN increases during the heating the insoluble N, hence coarse AlN does not increase at all in case of the continuously cast steel slabs, whereas the coarse AlN increases remarkably in case of the steel slabs prepared by ingot breaking. This fact causes the remarkable difference in the grain size of the austenite grains as shown in FIGS. 1 to 4, and has a great effect on the toughness as shown in FIG. 7.

The desired objects of the present invention can be obtained irrespective of presence of a small amount of alloying elements so far as Al and N are contained in the ranges as defined herein.

Examples of the present invention will be set forth in the table below in comparison with comparative steels.

Mechanical Properties of Steel Sheets produced under various conditions from Molten Steels prepared in Converters

| | Steel Compositions (%) | | | | | | | | Production Conditions | | Mechanical Properties | | |
|---|---|---|---|---|---|---|---|---|---|---|---|---|---|
| | C | Si | Mn | Ni | Cr | Mo | Al | N | Slab Production Method | Slab Heating Temp. (° C) | Yield Strength (kg/mm²) | Tensile Strength (kg/mm²) | vE-40 (kg-m) |
| Present Invention | | | | | | | | | | | | | |
| 1 | 0.08 | 0.31 | 1.30 | — | — | — | 0.03 | 0.006 | Continuous Casting | 1100 | 30 | 46 | 24.4 |
| 2 | 0.15 | 0.37 | 1.41 | — | — | — | 0.03 | 0.004 | " | 1100 | 38 | 54 | 19.3 |
| 3 | 0.09 | 0.24 | 1.25 | 0.42 | 0.20 | 0.11 | 0.04 | 0.007 | " | 950 | 35 | 51 | 20.7 |
| 4 | 0.14 | 0.23 | 1.31 | 0.37 | — | — | 0.04 | 0.004 | " | 1100 | 34 | 50 | 18.4 |
| 5 | 0.13 | 0.25 | 1.45 | — | — | — | 0.04 | 0.005 | " | 1100 | 36 | 52 | 16.8 |
| Comparative | | | | | | | | | | | | | |
| 6 | 0.12 | 0.24 | 1.23 | — | — | — | — | 0.005 | Continuous Casting | 1100 | 27 | 44 | 1.7 |
| 7 | 0.13 | 0.24 | 1.38 | — | — | — | 0.04 | 0.005 | " | 1250 | 33 | 50 | 2.1 |
| 8 | 0.13 | 0.27 | 1.46 | — | — | — | 0.04 | 0.005 | Ingot-Breaking | 1100 | 34 | 54 | 2.1 |
| 9 | 0.10 | 0.25 | 1.00 | — | Nb: 0.03 V: 0.06 | | 0.03 | 0.005 | " | 1100 | 46 | 55 | 7.2 |

It is clearly shown the steels 1 - 5 produced by the present invention are much better than the comparative steels 6 - 9 in respect of strength and toughness.

What is claimed is:

1. A process for producing a low alloy steel of fine grain structure containing 0.01–0.10% Al and 0.002–0.009% N and having excellent strength and toughness by a continuous casting process, which comprises continuously casting a molten steel having said composition to obtain a steel slab, cooling said steel slab to 500° C with an average cooling rate of not lower than 3° C/min., so as to prevent the precipitation of AlN, maintaining the slab temperature as cooled and reheating said slab for hot rolling to a relatively low temperature range from 900° to 1150° C so as to precipitate fine AlN while preventing the growth of austenite grains by accelerating the formation of AlN nuclei prior to the formation of austenite nuclei.

2. A process for producing a steel having excellent strength and toughness according to claim 1, in which the average cooling rate down to 500° C is not lower than 6° C/min. to obtain a steel slab containing nitrogen which precipitates as AlN in an amount not larger than 40% of the total nitrogen.

* * * * *